US005528269A

United States Patent [19]

Drogo et al.

[11] Patent Number: 5,528,269

[45] Date of Patent: Jun. 18, 1996

[54] SERVICING A NEWLY-INSTALLED INK PEN TO ELIMINATE UNEVEN PRINT QUALITY WITHOUT EXCESSIVE WASTING OF INK

[75] Inventors: Frank Drogo, San Marcos; Ronald A. Askeland, San Diego, both of Calif.; Brian P. Canfield, Barcelona, Spain

[73] Assignee: Hewlett-Packard Company, Palo Alto, Calif.

[21] Appl. No.: 236,292

[22] Filed: May 2, 1994

[51] Int. Cl.[6] ..... B41J 2/165

[52] U.S. Cl. ..... 347/19; 347/23; 347/30; 347/35; 347/87

[58] Field of Search ..... 347/14, 19, 22, 347/23, 29, 30, 35, 44, 49, 86, 87, 108; 400/692

[56] References Cited

U.S. PATENT DOCUMENTS

| | | | |
|---|---|---|---|
| 4,577,203 | 3/1986 | Kawamura | 347/30 |
| 4,791,435 | 12/1988 | Smith et al. | 347/35 |
| 4,970,553 | 11/1990 | Saito et al. | 347/19 |
| 5,162,817 | 11/1992 | Tajika et al. | 347/19 |

FOREIGN PATENT DOCUMENTS

| | | | |
|---|---|---|---|
| 0535686 | 4/1993 | European Pat. Off. | 347/23 |
| 60-01054 | 6/1985 | Japan | 347/23 |
| 4-347655 | 12/1992 | Japan | 347/23 |
| 5-31909 | 2/1993 | Japan | 347/23 |
| 5-69553 | 3/1993 | Japan | 347/29 |

*Primary Examiner*—John E. Barlow, Jr.

[57] ABSTRACT

An inkjet printer has a pen holder for removably holding an ink pen, a detector circuit for detecting whether ink with a degraded quality is likely to be ejected by said ink pen, and a servicing circuit responsive to said detector circuit for causing an initial quantity of ink to be discharged from said ink pen to ensure that ink with a degraded quality will not be used during normal printing.

14 Claims, 5 Drawing Sheets

SERVICING A NEWLY-INSTALLED INK PEN TO ELIMINATE UNEVEN PRINT QUALITY WITHOUT EXCESSIVE WASTING OF INK

TECHNICAL FIELD

The present invention relates in general to inkjet printers with replaceable ink pens and more particularly to an improved servicing scheme for eliminating uneven print quality of new and/or newly-installed ink pens at start-up.

BACKGROUND ART

When an ink pen of a thermal inkjet printer containing relatively heavy pigmented particles disbursed in a relatively light unpigmented fluid vehicle has been stored for a long period of time in other than its normal upright position, there will be a tendency for some of the pigmented particles to migrate out of the nozzle chamber. When such a pen is first placed into service, the initial print drops will thus be slightly smaller and lighter than normal. After the individual nozzles have been fired a certain number of times, any relatively unpigmented liquid in the vicinity of the nozzles will have been discharged and/or the pigments will have been more uniformly distributed and the pen will begin to print in the normal optical density. As a result, the print quality achievable with a newly installed pen may be uneven and unpredictable. Particularly if the pen and/or the printer is new and the user in not familiar with such a possible unevenness in print quality, the user may think that the pen and/or the printer is defective, thereby causing consumer dissatisfaction and unnecessary warranty claims and service calls.

Some prior art printers perform, each time they are turned on and/or prior to printing each page, one or more ink ejection ("spitting") and/or other servicing operations ("priming" and/or "wiping") to preheat and clean the individual nozzles and to clear viscous plugs therefrom; however, such routine servicing may not be sufficient to ensure that the ink in the vicinity of the nozzles of a new or newly-installed pen is properly mixed. In some prior art printers, certain nozzle clearing operations are performed whenever an inspection door has been manually opened and closed. In any event, if sufficient ink ejections to completely eliminate any poorly pigmented liquid in the vicinity of the nozzle chamber are made each time the printer is turned on and/or each time the inspection door is opened, a large quantity of ink will be unnecessarily wasted.

SUMMARY OF THE INVENTION

It is an overall objective of the present invention to eliminate uneven print quality of a new and/or newly-installed ink pen at start-up, and thereby eliminate uncertainty about the soundness of a new pen, without requiring excessive wastage of ink.

In accordance with an overall aspect of the present invention, there is provided an inkjet printer which has a pen holder for removably holding an ink pen, detector means for detecting whether ink with a degraded quality is likely to be ejected by said ink pen, and discharge means responsive to the detector means for causing a quantity of ink to be ejected from said ink pen to eliminate any inadequately pigmented ink from the nozzle area, before commencing normal printing.

DETAILED DESCRIPTION OF THE PREFERRED EMBODIMENT

Figure 1:
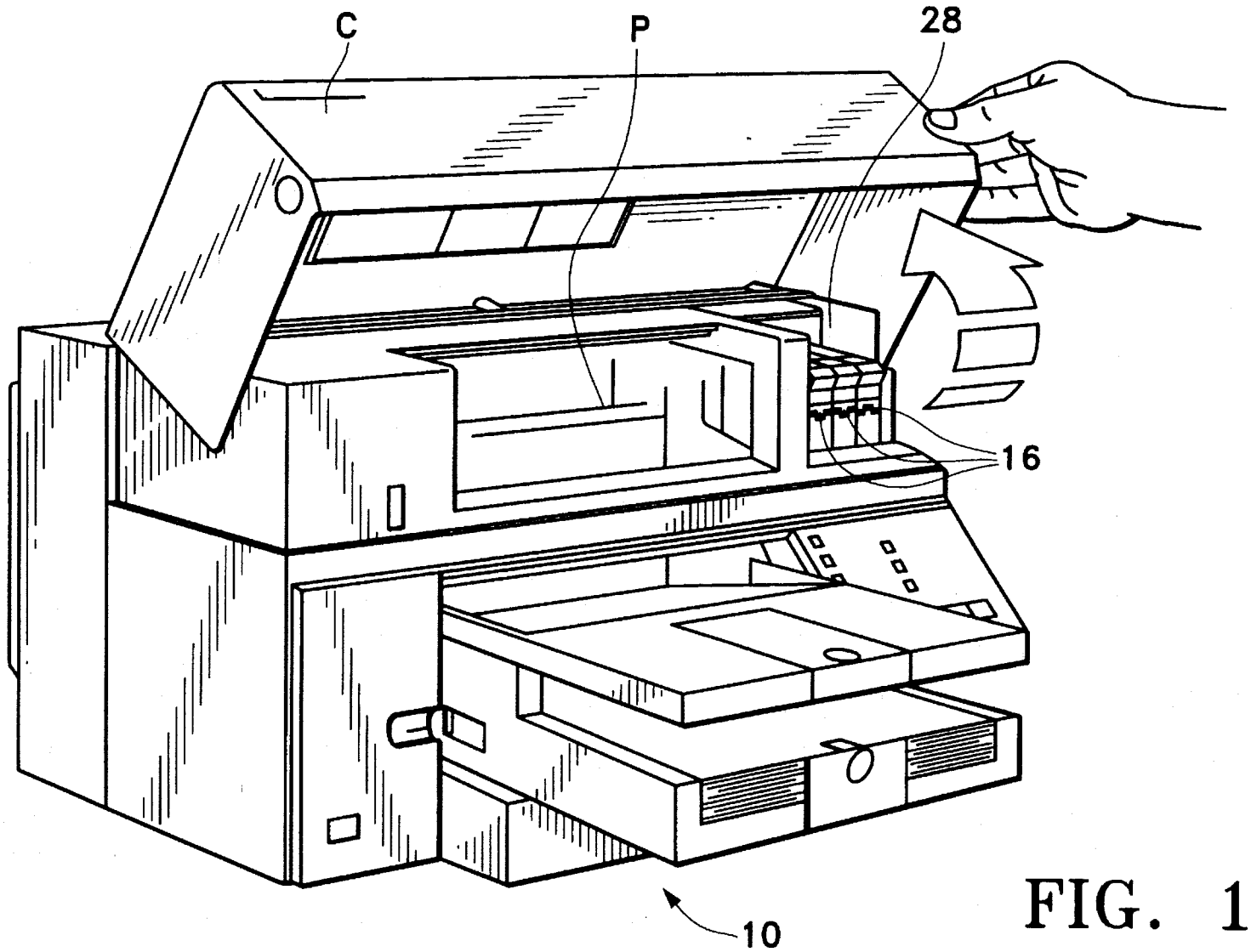
FIG. 1 is an isometric view of an inkjet printer incorporating the present invention.
Figure 2:
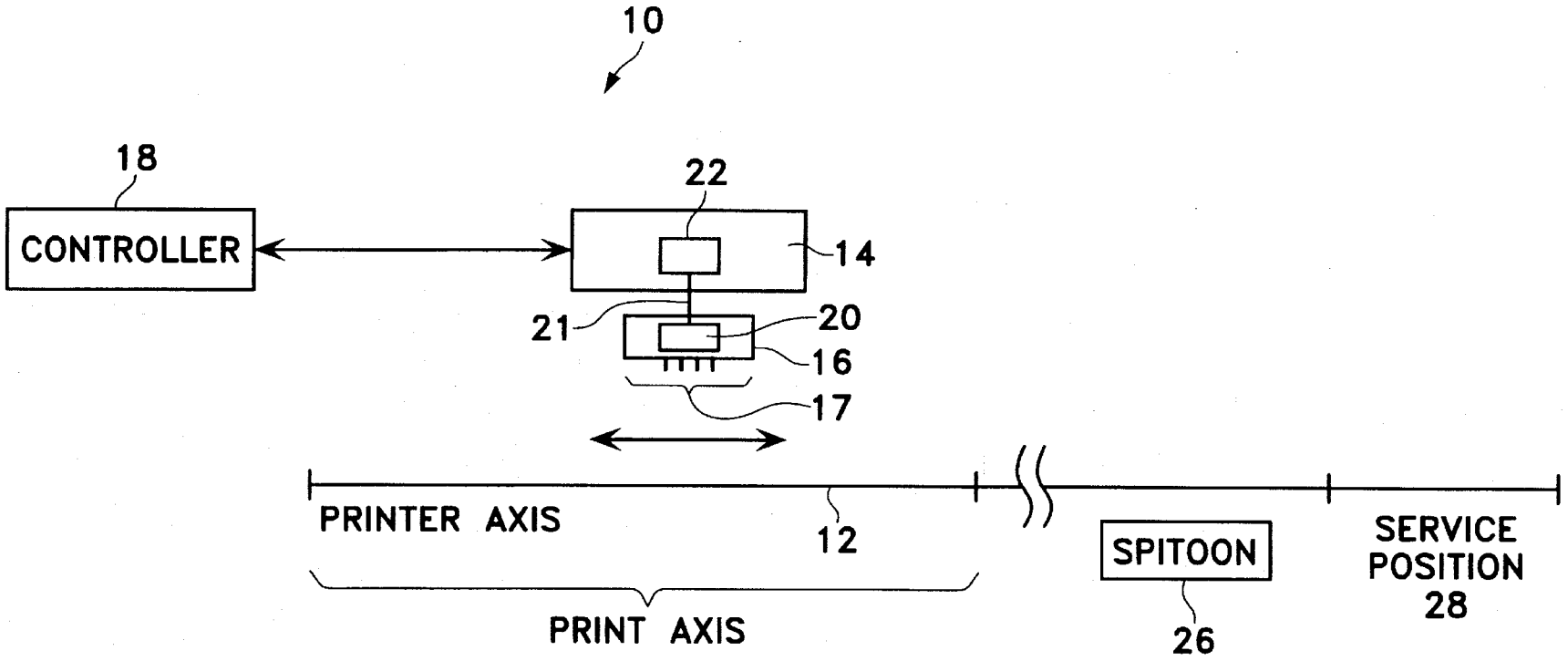
FIG. 2 is a block diagram of the control system of an inkjet printer wherein the present invention is embodied.

FIG. 1 is an isometric view of an inkier printer 10 incorporating the present invention. A block diagram of the control system of the thermal inkjet printer 10 is shown in FIG. 2. In particular, inkjet printer 10 includes a plurality of ink pens, each in the form of a cartridge 16, carried along a printer axis 12 in individual compartments of a cartridge holder 14. After cover C has been closed, printing may be accomplished in a printing area P by firing selective inkjet nozzles 17 at the lower most surface of each printer cartridge 16 onto a printing medium (not shown).

The operations of the inkjet printer 10 is controlled by a controller 18, which not only controls movement of the cartridge holder 14 along the printer axis 12, but also produces nozzle firing signals to cause individual drops of ink to be fired from the nozzles 17, and which controls and/or otherwise monitors the viscosity of the ink in the vicinity of the nozzles to maintain uniformity of the ink drops.

Each cartridge 16 has an electrical circuit 20 which preferably includes such elements as a temperature sensor in addition to the conventional firing resistors used for vaporizing a small quantity of liquid ink and thereby causing drops of ink to be fired from the nozzles 17. The electrical circuit 20 is connected to the controller 18 through a print drive interface circuit 22 which is mounted on the cartridge holder 14.

Figure 3:
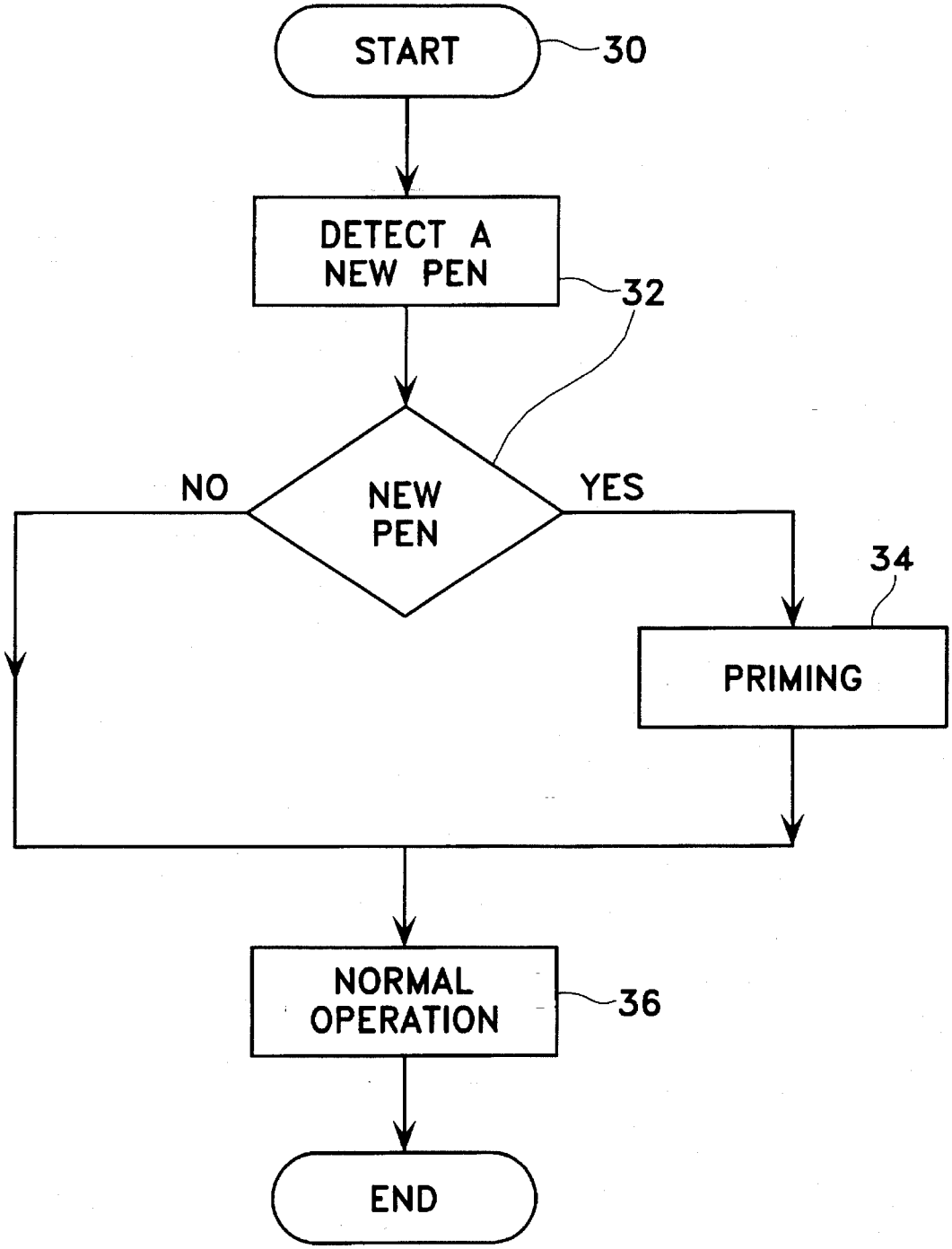
FIG. 3 is a flow chart showing in general the main operations of the printer of FIG 1.

Refer to FIG. 3, operation of the printer 10 preferably includes the step of detecting 32, after a power-on or a servicing operation 30, whether a new cartridge 16 is installed. If block 32 indicates that a new cartridge 16 may have been installed containing a type of ink (for example particles of carbon black disbursed in an aqueous vehicle) that is likely to separate into pigmented and unpigmented portions, an ink discharge operation 34 is performed by the controller 18 to cause an initial quantity of ink to be ejected from the cartridge 16. Although the discharge operation 34 will typically be a "spitting" operation in which discrete drops of ink are successively fired from each nozzle, it could also be implemented as a "priming" operation in which a negative pressure is applied to one or more nozzles for a predetermined time, thereby allowing ink and any other air, liquids, or other fluids inside the pen in the immediate vicinity of the nozzle to be sucked out. After a quantity of ink has thus been ejected or otherwise discharged in discharge operation 34, the controller 18 executes its normal operations 36, which it, as disclosed in more detail in copending commonly assigned application of L. Stewart et al entitled PEN START UP ALGORITHM FOR BLACK AND COLOR THERMAL INK-JET PENS filed on 30 Apr. 1993 under Ser. No. 08/056,243, said application being hereby incorporated by reference, may include regular spitting, priming, and/or wiping operations to test and calibrate the individual nozzles and to clear any congealed ink in the vicinity of the nozzle openings, to thereby maintain optimal performance even during particularly demanding applications.

Since a new printer will normally be shipped without any pen installed in the cartridge holder 16 and since a replacement pen cannot be installed without first removing any previously installed pen, block 32 preferably includes the step of detecting whether a cartridge 16 has been removed from the printer 10. Removal of the cartridge 16 from the printer 10 can be detected by detecting a break in one or more electrical paths 21 between the electrical circuit 20 and the print drive interface circuit 22 caused by the cartridge 16 having been removed from the cartridge holder 16.

Figure 4:
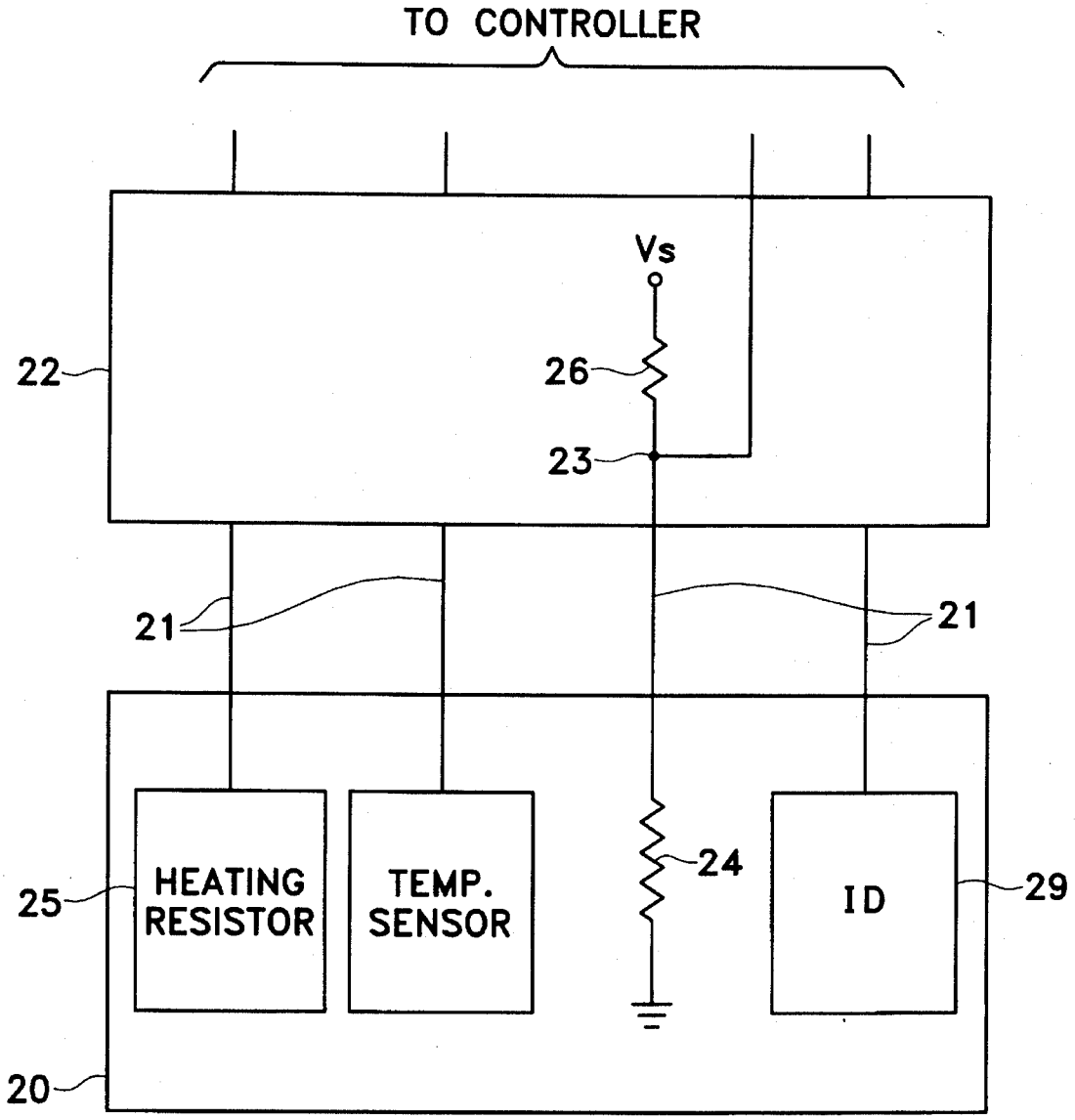
FIG. 4 is a diagram which illustrates some electrical paths between a print drive circuit on a cartridge holder and an electrical circuit on a cartridge which can be used to detect whether a new cartridge is installed.

For example, the electrical circuit 20 of the printer 10 may include a sample resistor 24 having a resistance equal to a predetermined ratio of the heating resisters of the nozzles 17, as shown in FIG. 4, which is provided to allow the controller 18 to determine the resistance of the heating resisters 25 and thereby to determine the proper amount of energy that needs to be applied to the heating resisters 25 to optimally heat the ink. Under one implementation, the sample resistor 24 is connected to a voltage source Vs via a precision resistor 26, which is located in the print drive interface circuit 22 and the voltage at the junction 23 between the precision resistor 26 and the sample resistor 24 is sampled by the controller 18 to determine the resistance of the sample resistor 24. Accordingly, the voltage at the junction 23 can be sampled by the controller 18 to detect whether the cartridge 16 is present. If the cartridge 16 is absent (ie, has been removed), the sample resistor 24 will also be absent and the voltage at the junction 23 will equal to Vs.

Other electrical paths, such as the electrical paths to the firing or heating resistors 25, can also be used to monitor removal of the cartridge 16 from the printer 10.

To allow the controller 18 to determine whether a new cartridge 16 is installed that has not already been subject to an initial service routine that includes discharging a predetermined quantity of ink from each nozzle in accordance with the present invention, an identification 29 can be provided on the cartridge 16. The identification 29 can be implemented by randomly connecting a plurality of fuses into the electrical circuit 20 of the cartridge 16 which may thereby be used to generate a corresponding random digital number to be read by the controller 18.

The identification 29 of a cartridge 16 could also be a function of the resistance of a selected set of resisters (e.g., the firing resistors 25) in the electrical circuit 20 of the cartridge 16, utilizing the slight differences of these resistors caused by manufacturing tolerances, which if determined with sufficient accuracy, might provide a uniqueness of the identification of the cartridge 16.

Alternatively, the inkjet printer 10 may have a bar code reader for reading an optical bar code affixed on the cartridge 16. The bar code may include an alphanumeric serial number code having enough digits to ensure a high probability of detection of a different cartridge being installed in the printer 10. Such a bar code could be a random number. Alternatively, the cartridges 16 could be serially given different bar codes before they are packed together in a box for shipment, so that a printer 10, even if successively loaded with several cartridges from the same box, will always detect the new cartridges as having different bar codes.

In one implementation, when a service operation is detected, the serial number is read by the controller 18 into a memory in the controller 18. The memory can be non-volatile (e.g., a battery back-up memory or EEPROM), or can have temporary power supply (e.g., by connecting to a capacitor) that is sufficient to maintain its content during a time interval estimated as normally required for a pen service operation. When a cartridge 16 is installed, its serial number is read and compared with the content of the memory. A difference in the two data will indicate that a new cartridge 16 has been installed.

Figure 6:
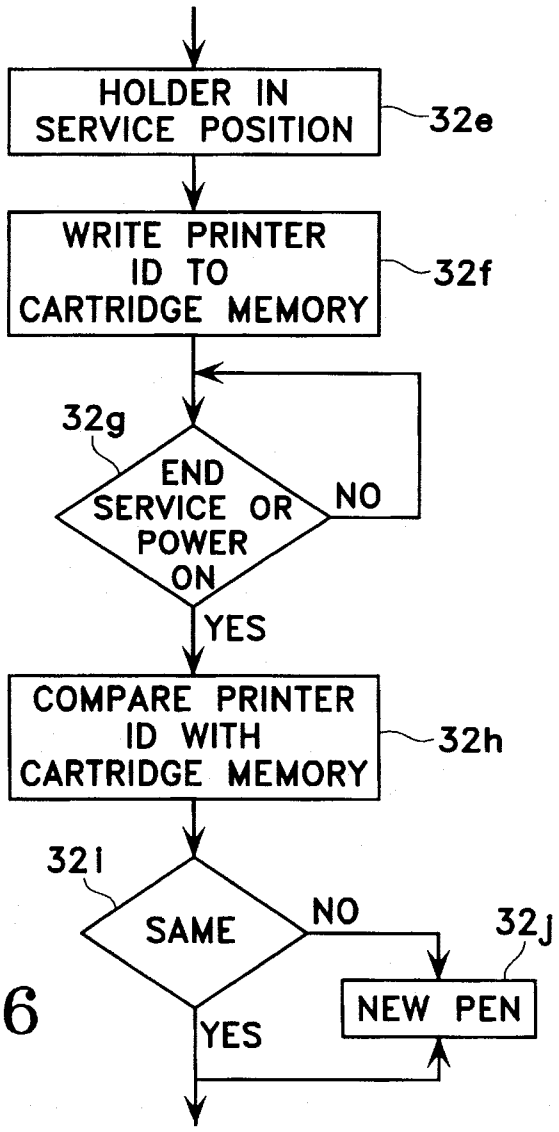
FIG. 6 shows a second scheme for detecting a new pen.
Figure 5:
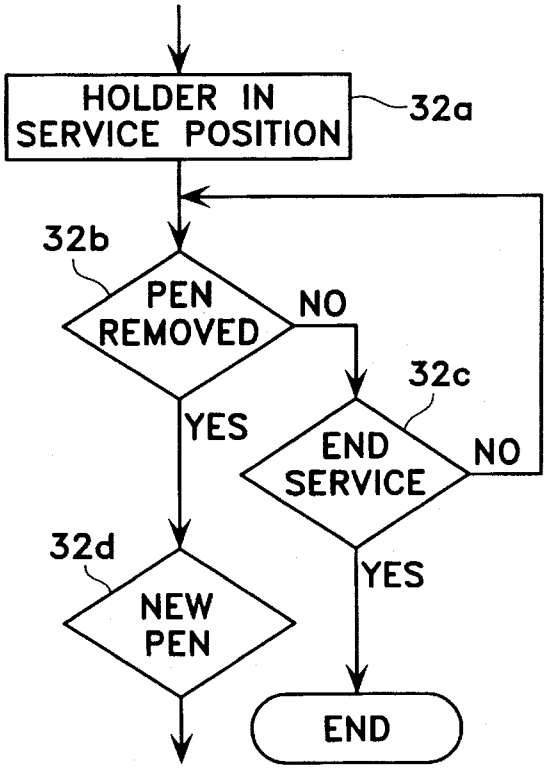
FIG. 5 shows a first scheme for detecting a new pen.

Alternatively, as shown in FIG. 6, each printer 10 can be given a unique identification. Under such implementation, each cartridge 16 is provided with a non-volatile cartridge memory, such as an EEPROM. Referring to FIG. 6, after the desired initial quantity of ink has been discharged from the new cartridge and before any subsequent initiation of other service operation **32*e* (typically performed when the cartridge 16 is at a service position as described hereinafter), the printer 10 will write its identification on the cartridge memory (step 32*f*). After a possibly new cartridge 16 has been installed (step 32*g*), the controller 18 will check the content of the cartridge memory against the printer's identification (step 32*h*). If the two are different (step 32*i*), the cartridge 16 is new to the printer 10 (step 32*j*) and the initial ink discharge operation is performed. Instead of writing the printer's identification at the beginning of the service operation, the controller 18** could equally well write the printer's identification onto the cartridge memory after the initial discharge of ink has been performed.

In yet another implementation of the required detecting means, a fuse can be provided in the electrical circuit of the cartridge 16. The fuse will be blown after the new cartridge has been detected and before normal operation of the printer 10 has commenced. When a cartridge 16 is installed in the printer 10, the controller 18 first detects the presence of the fuse. If and only if the fuse is present, the controller 18 will conclude that the cartridge 16 is a new one that must be serviced before it can be placed into normal operation.

Alternatively, the cartridge 16 could be provided with an opening covered by a knockout which, as the cartridge 16 is installed, will activate a switch on the holder 14, and cause a signal to be sent to the controller 18, signifying that a new cartridge is installed. By designing the knockout such that it is displaced to an inactive position only after the cartridge is fully seated, and/or as the cartridge 16 is being moved away from the holder 14, it will be possible to ensure that only a new cartridge will be detected in block 32.

Detection of whether a cartridge 16 is newly-installed in the printer 10 is preferably performed only at preselected time instances outside of normal printing operations. For example, if a break in the selected electrical path(s) of the cartridge's electrical circuit 20 is used to monitor removal of a cartridge 16, as above described, the print drive interface circuit 22 can be implemented to generate an interrupt to the controller 18 if the resistance of the selected electrical path (or a threshold voltage at a node of the selected electrical path) is over a preselected threshold. Alternatively, opening of the printer's cover or the printer's latch can cause an interrupt to the controller 18 to signal that a service operation has commenced. When the interrupt is received, the controller 18 will periodically poll the resistance of the selected electrical path(s). By this means, the efficiency of controller 18 is improved during normal operation.

In another exemplary embodiment, the cartridge 16 can only be inserted or removed when it is moved to a predefined service position 28 (e.g., in response to activation of a button on the printer 10) and not when the cartridges is in the print position P (see FIG. 1). When the cartridge 16 is moved to the service position 28 (step 32*a*) and/or when the access door or cover C of the printer 10 is open, the controller 18 will periodically sample the preselected electrical path(s) to see whether the cartridge 16 is removed (step 32*b*). If the cartridge 16 has been removed, the controller 18 will check whether the cartridge 16 is new after it is installed. Because the sampling is performed only when the cartridge 16 is being serviced, interference caused by the detection means to printing operations is further reduced.

Upon detecting that a new cartridge 16 is installed (e.g., the identification of the newly installed pen is different from the stored identification), the controller 18 moves the cartridge holder 14 to a position where a spittoon 26 is located. When the cartridge holder 14 reaches the spittoon 26, the controller 18 then fires the nozzles 25 a predetermined number of times to eject the unpigmented liquid which may have occupied the nozzle chamber. The amount of ink (e.g., the number of drops of ink) to be ejected during initial servicing operation may depend upon whether the pigment is dissolved in, or merely disbursed in, the vehicle, and the extent to which the ink is subject to phase separation, as well as other optical, chemical and physical properties of the pigment and the vehicle. In a preferred embodiment, as disclosed in copending commonly assigned application of J. Stoffel et al entitled COLOR INK-JET PRINTER WITH PIGMENT BLACK AND DYE-BASED COLOR INKS filed on 27 Apr. 1994 under Ser. No. 08/234,202, said application being hereby incorporated by reference, more than one type of ink may be used; only the black ink is pigment based and requires an initial servicing operation in accordance with the present invention, while the colored inks are dye-based and not particularly prone to phase separation. Each type of ink is preferably associated with a different compartment of the cartridge holder 14 having a separate set of electrical contacts 21, and thus can be readily identified; more detailed information identifying the type of ink can be stored in a field along with the identification of the cartridge 16. Alternatively, the cartridge 16 could also be coded with information relating to the number of drops which should be discharged from the printer 10 during the initial servicing operation.

It is understood that the above-described embodiments are merely provided to illustrate the principles of the present invention, and that other embodiments may readily be devised using these principles by those skilled in the art without departing from the scope and spirit of the invention.

What is claimed is:

1. A thermal inkjet printer, comprising:

an ink pen having an electrical resistance for heating ink, a pen holder for removably holding the ink pen, analog measurement means for measuring an analog value associated with said electrical resistance, digital identification means for providing a serial number distinguishing said pen from a plurality of similar pens, new pen means responsive to both said analog measurement means and to said digital identification means for determining whether said pen has been previously serviced, discharge means responsive to said new pen means for servicing said ink pen by causing a predetermined initial quantity of ink to be discharged from said ink pen only if said pen has not been previously serviced by said discharge means, wherein said new pen means prevents excessive waste of ink by preventing said discharge means from discharging said predetermined initial quantity of ink from said pen if the pen had previously been installed in the pen holder and serviced by the discharge means.

2. The inkjet printer of claim 1, wherein said digital identification means includes electrical means pre-programmed to form an identification code.

3. The inkjet printer of claim 1, wherein said printer further includes access means having an access condition for facilitating insertion and removal of a pen from a pen holder in said printer and an operational condition during which said pen cannot readily be removed from said holder, and said new pen means is activated when said access means is in said access condition.

4. The inkjet printer of claim 3, where said access means comprises an access door and an electrical contact operated by said access door, and said access condition is activated when said electrical contact indicates said access door is open.

5. The inkjet printer of claim 3, wherein said access means comprises relocation means for causing said pen holder to relocate to a pen service position, and said access condition is activated when said pen holder is in said pen service position.

6. The inkjet printer of claim 1, wherein said printer further includes pen detection means for determining whether said pen is inserted in said pen holder, and said new pen means is activated when said pen detecting means indicates said pen may have been removed from said pen holder.

7. In a thermal inkjet printer with a removable ink pen, a method for eliminating uneven print quality of a newly-installed pen without excessive waste of ink, comprising the steps of:

detecting whether the pen is a new pen that has not been previously serviced and that ink with a degraded quality is therefore likely to be erected by said ink pen, said detecting step including measuring an analog resistance and reading a digital serial number, and servicing said ink pen, in response to a detection that said pen is a new pen, to cause a predetermined initial quantity of ink to be discharged from said ink pen, whereby said initial quantity of ink is discharged only if the ink pen is a new pen that has not been previously serviced.

8. The method of claim 7, wherein said pen includes a plurality of individual nozzles and said servicing step includes a step of firing each of the nozzles for a predetermined number of times, to thereby perform a spitting operation in which a predetermined number of individual drops of fluid are discharged from each of said nozzles.

9. The method of claim 7, wherein the ink pen has an electrical circuit for heating the ink, and the detecting step includes the step of detecting a break in an electrical path of said electrical circuit, thereby indicating that the pen has been removed from an associated pen bolder.

10. The method of claim 9, further includes the step of:

storing an identification code derived from a previously measured analog resistance and a previously read digital serial number for identifying a pen which has been previously serviced by said printer.

11. The method of claim 10, wherein said digital serial number is provided by a pre-programmed electrical circuit.

12. The method of claim 7, wherein:

said printer has an access condition for insertion and removal of an ink pen from said printer and an operational condition during which said ink pen cannot readily be removed from said printer, and said detecting step includes the step of determining whether said printer is in said access condition.

13. The method of claim 12, wherein said access condition is entered when an access door in said printer is opened.

14. The method of claim 7, wherein:

the printer has a pen service position, and said detecting step includes the step of determining whether said printer is in said pen service position.

* * * * *